US009540150B1

(12) United States Patent
Symank et al.

(10) Patent No.: US 9,540,150 B1
(45) Date of Patent: Jan. 10, 2017

(54) STOPPER WITH SHEATH FOR A CONTAINER

(71) Applicants: Douglas Symank, College Station, TX (US); Mark Golden, College Station, TX (US)

(72) Inventors: Douglas Symank, College Station, TX (US); Mark Golden, College Station, TX (US)

( * ) Notice: Subject to any disclaimer, the term of this patent is extended or adjusted under 35 U.S.C. 154(b) by 0 days.

(21) Appl. No.: 14/829,085

(22) Filed: Aug. 18, 2015

Related U.S. Application Data

(63) Continuation-in-part of application No. 14/198,066, filed on Mar. 5, 2014, now abandoned.

(60) Provisional application No. 61/805,491, filed on Mar. 26, 2013.

(51) Int. Cl.
*B65D 39/00* (2006.01)
*B65D 39/16* (2006.01)

(52) U.S. Cl.
CPC ..... *B65D 39/0052* (2013.01); *B65D 39/0005* (2013.01); *B65D 39/0029* (2013.01); *B65D 39/16* (2013.01)

(58) Field of Classification Search
CPC . B65D 39/0005; B65D 39/0052; B65D 39/16; B65D 39/0023; B65D 39/0029
USPC ..... 215/355, 264; 220/801, 802–804
See application file for complete search history.

(56) References Cited

U.S. PATENT DOCUMENTS 1,546,159 A 9/1924 Wippler
3,074,578 A 1/1963 Hestor

*Primary Examiner* — James N Smalley
(74) *Attorney, Agent, or Firm* — Michael Diaz

(57) ABSTRACT

A stopper for use with a container containing liquids, solids, or gases. The stopper includes a main body. The main body includes an upper portion. The upper portion has a diameter greater than a diameter of an opening of the container. The stopper also includes a flexible sheath affixed to the stopper. The sheath can be rolled down an exterior surface of the container to facilitate a seal of the container. In addition, the main body includes an annular groove sized and shaped to retain the sheath when rolled up. In one embodiment the present invention may include a lower portion having a plug sized and shaped to fit within the opening of the container to prevent liquids, solids, or gases contained in the container from exiting the opening.

13 Claims, 9 Drawing Sheets

STOPPER WITH SHEATH FOR A CONTAINER

RELATED APPLICATIONS

This application is a continuation-in-part application of co-pending U.S. patent application Ser. No. 14/198,066 entitled "Stopper With Retractable Seal For a Container" filed on Mar. 5, 2014 under the names of Doug Symank and Mark Golden which claims the benefit of U.S. Provisional Patent Application Ser. No. 61/805,491 filed Mar. 26, 2013 by Doug Symank and Mark Golden, which is hereby incorporated by reference.

BACKGROUND OF THE INVENTION

Field of the Invention

This invention relates to stoppers for stopping openings of containers holding liquids, solids, or gases. Specifically, and not by way of limitation, the present invention relates to a stopper having an additional retractable sheath for a container holding liquids, solids, or gases.

Description of the Related Art

There are a wide variety of containers holding liquids that have stoppers. The typical stopper forms a barrier to prevent liquid from exiting the container opening. A popular example of a container holding liquids requiring a stopper is a wine bottle. The wine bottle has a long stem with an opening. Traditionally, these wine bottles are sealed with cork stoppers. These cork stoppers have been used for centuries and for a variety of reasons, most of which are related to the ready availability of cork and the exceptional natural qualities of cork which make it useful as a stopper. In particular, a cork is resilient, durable, sparingly permeable to gas, mostly waterproof, does not rot and can be easily compressed and shaped. Thus, for the above reasons, cork is an obvious material to consider for sealing fluid in a container, such as a wine bottle.

However, although cork material has been used successfully for many years, there are several drawbacks in both the material and configuration of the cork stoppers. First, the cork often leaves contaminants in the wine, which obviously can affect the taste and quality of the wine. Additionally, the cork stopper is difficult to remove from the bottle and is often damaged or even made unreuseable in the process. Various de-corking devices have been used to make the task easier for removing the cork from the bottle opening. Even more difficult is the task of re-seating the cork in the bottle opening as the cork tends to expand after initially removing the cork from the opening. Re-seating the cork completely within the neck of the bottle to effect the original seal's integrity is very difficult.

Furthermore, a device is needed which enables a stopper to have a fully retractable sheath which may be held in place in a retracted position either on or off the container. Although there are no known prior art teachings of a solution to the aforementioned deficiency and shortcoming such as that disclosed herein, prior art references that discuss subject matter that bears some relation to matters discussed herein are U.S. Pat. No. 3,074,578 to Hester (Hester) and U.S. Pat. No. 1,546,159 to Wippler (Wippler).

Hester discloses a container closure having a stopper with an attached band that is configured to flip down into a "bead" of the container. The band is sized to latch the stopper to the bottle by flipping the band down over the mouth of the band. Hester further states that the flange which is attached to the band is sized to allow the band no further movement than the length necessary to reach the bead or groove in the container. Thus, Hester fails to disclose a sheath that can be rolled completely down the stem of the bottle. In addition, Hester does not disclose a configuration for holding a rolled up sheath to be held in a retracted position.

Wippler teaches a milk bottle closure having a thick portion with a groove and a thin portion which can be rolled up into a groove. However, the closure is configured to have the groove located below the lip of the milk bottle. By having the groove located below the lip of the milk container, the rolled up thin portion will roll down since there is no mass behind or below the groove to prevent the thin portion from rolling down. Specifically, the closure is configured with a gap for placement on the lip of the milk bottle. Without the milk bottle within the gap, there is no support behind the groove to hold the thin portion in the rolled up position. Wippler requires that the closure, when removed from the milk bottle, be manually rerolled into the rolled up position with each use before it could be repositioned on the milk bottle.

Thus, a stopper for a container holding liquid is needed which enables ease in removing the stopper from the opening and easily re-seats the stopper in the opening when re-sealing the bottle. Additionally, the stopper must be able to retain a rolled up sheath in a retracted position whether the stopper is in place upon the container or apart from the container when not in use. It is an object of the present invention to provide such an apparatus

SUMMARY OF THE INVENTION

In one aspect, the present invention is a stopper for a container retaining liquids, solids, or gases. The stopper includes a main body. The main body includes an upper portion. The upper portion has a diameter greater than a diameter of an opening of the container. In one embodiment the present invention may include a lower portion having a plug sized and shaped to fit within the opening of the container to prevent liquids, solids, or gases contained in the container from exiting the opening. The plug prevents liquids, solids, or gases contained in the container from exiting the opening. The stopper also includes a flexible sheath affixed to the stopper. The sheath can be rolled down an exterior surface of the container to facilitate a seal of the container. In addition, the main body has an annular groove sized and shaped to retain the sheath when rolled up either on or off the bottle.

DESCRIPTION OF THE INVENTION

Figure 1:
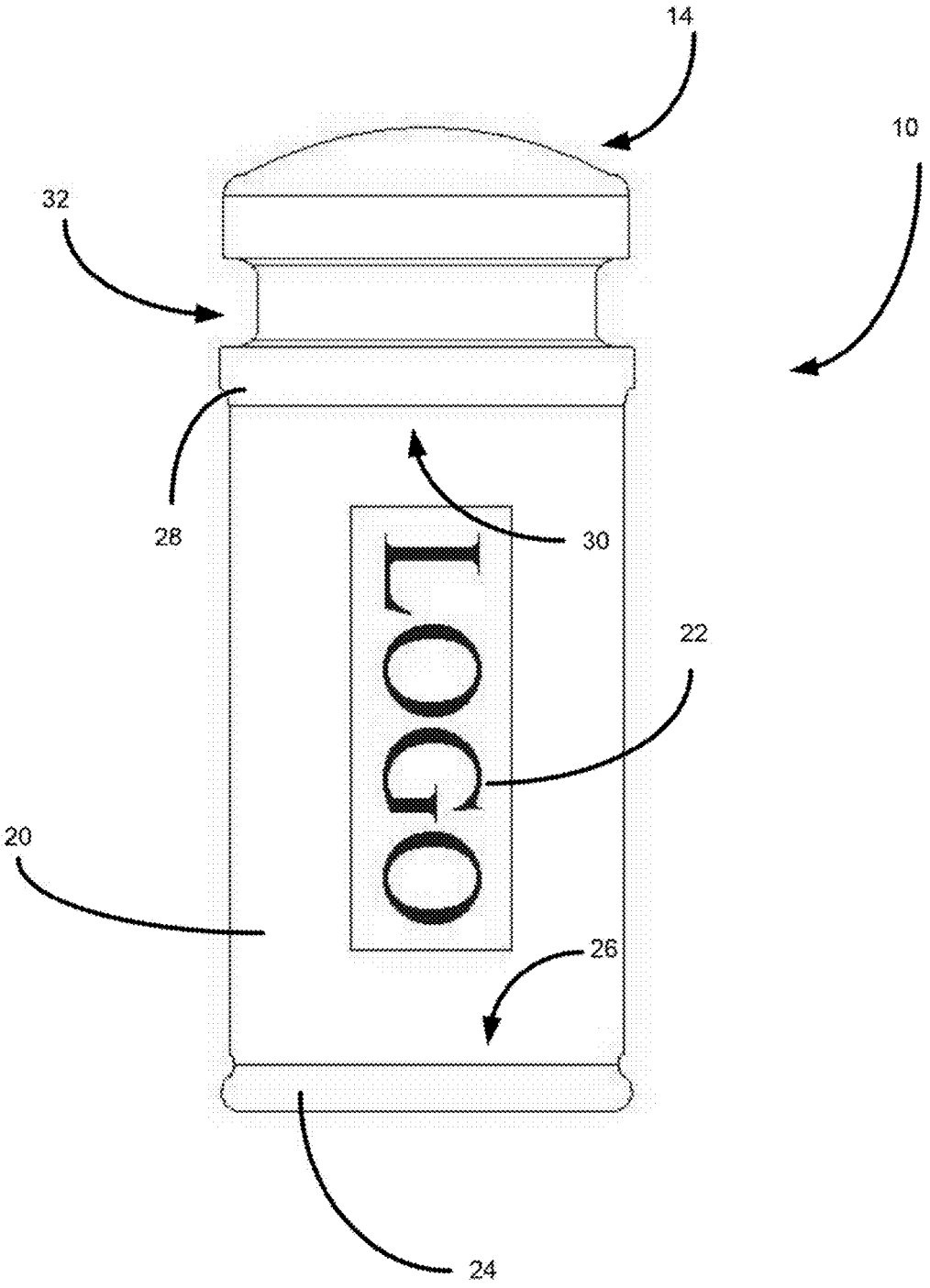
FIG. 1 is a side view of the stopper with the sheath in an extended position.
Figure 2:
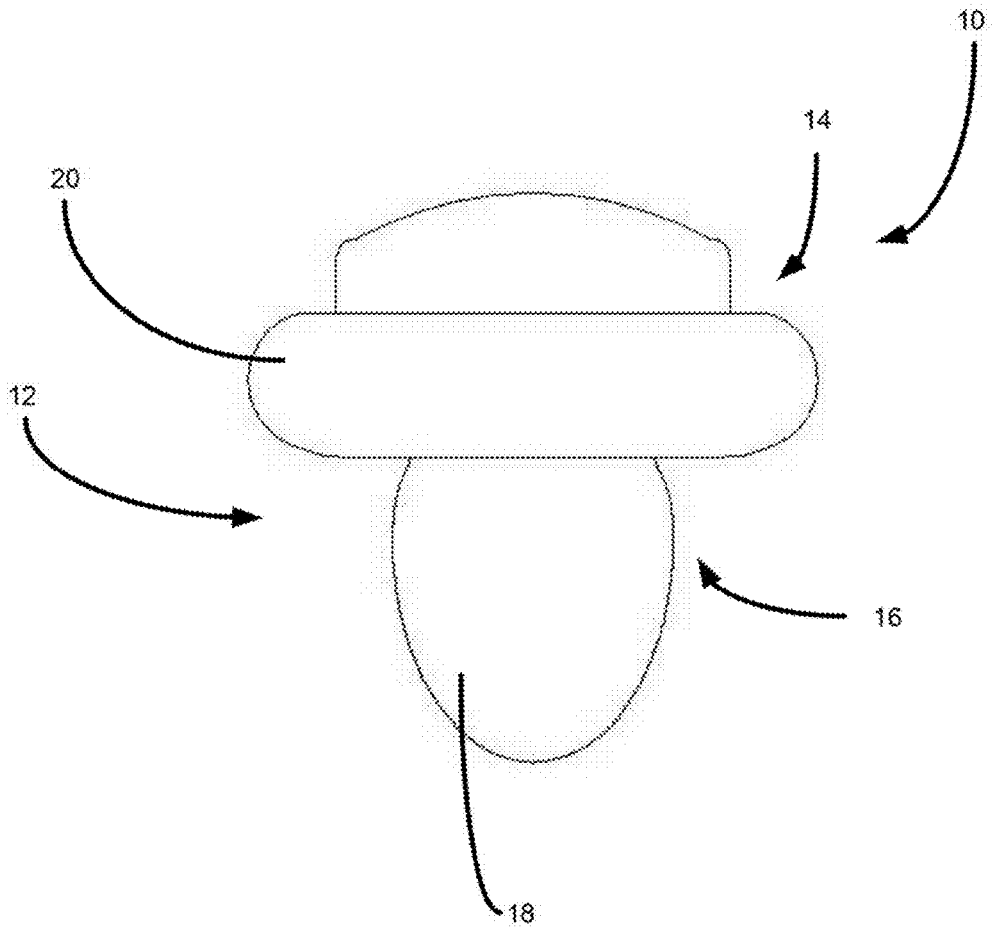
FIG. 2 is a side view of a stopper in a retracted configuration in one embodiment of the present invention.

The present invention is a stopper for an opening of a container containing liquids, solids, or gases, such as a wine bottle. FIG. 1 is a side view of the stopper 10 with the sheath 20 in an unrolled or extended position. FIG. 2 is a side view of a stopper 10 in a retracted configuration in one embodiment of the present invention. The stopper 10 is substantially circular having a main body 12 comprising an upper portion 14 and an optional lower portion 16 located adjacent and directly below the upper portion. With the embodiment having the lower portion, the lower portion 16 includes a plug 18 sized and shaped to fit snugly within the opening, thereby preventing the contents contained in the container (e.g., bottle) from exiting the container. The optional plug preferably has a diameter slightly greater than the diameter of the opening of the container. In the preferred embodiment of the present invention, the plug is constructed of a resilient yet malleable material such as a soft malleable plastic or rubber. Thus, when the plug is inserted within the opening of the container, it deforms and a seal is formed between the plug and the container opening. The upper portion 14 is sized and shaped to fit over the opening, typically having a circumference greater than the border of the opening of the container. Adjacent the upper portion of the stopper is a roll down sheath 20 circumferentially positioned and attached to an outer surface of the stopper, preferably around the bottom of the upper portion of the stopper with an inside circumference slightly less than the outer circumference of the stem of the container or bottle. As depicted in FIG. 2, the sheath is rolled up to a retracted position. The sheath is preferably constructed of a flexible, waterproof, elastic material, such as a latex, silicone, polyurethane, polyisoprene or similar material. Additionally, the sheath is configured to fit tightly over an exterior surface of a container in the rolled down position. It should be understood that the lower portion 16 and plug 18 are optional. In another embodiment, the present invention may include a stopper with an upper portion without the lower portion and plug.

In the embodiment having the plug 18, once the stopper is positioned over the opening and the plug 18 is inserted into the opening, the sheath 20 is rolled down over the stem of the container or bottle. In the embodiment without the plug 18, the stopper still includes the sheath 20 which may be rolled down the stem of the container or bottle. The sheath 20 may also include a region for displaying a logo 22 or other design. The sheath may be configured to roll down the exterior surface of the container below the main body a length necessary to develop the surface contact area, dictated by the coefficient of friction between the sheath and the exterior surface of the container, required to contain pressure of contents held within the container. The sheath may include a reinforced ring 24 located at a lower end 26 of the sheath.

Figure 3:
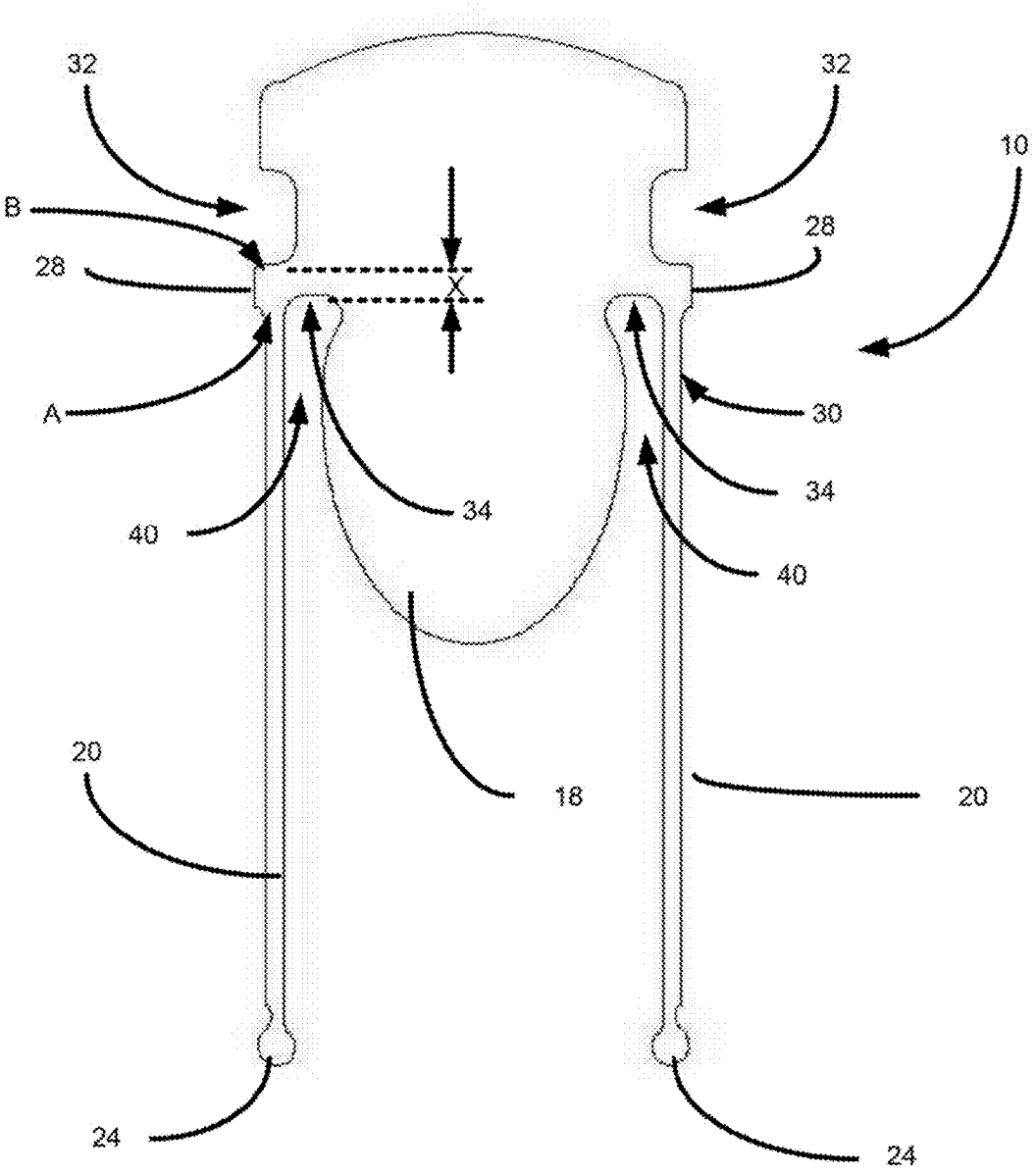
FIG. 3 is a cross sectional view of the stopper with the sheath in the rolled down or extended position.
Figure 4:
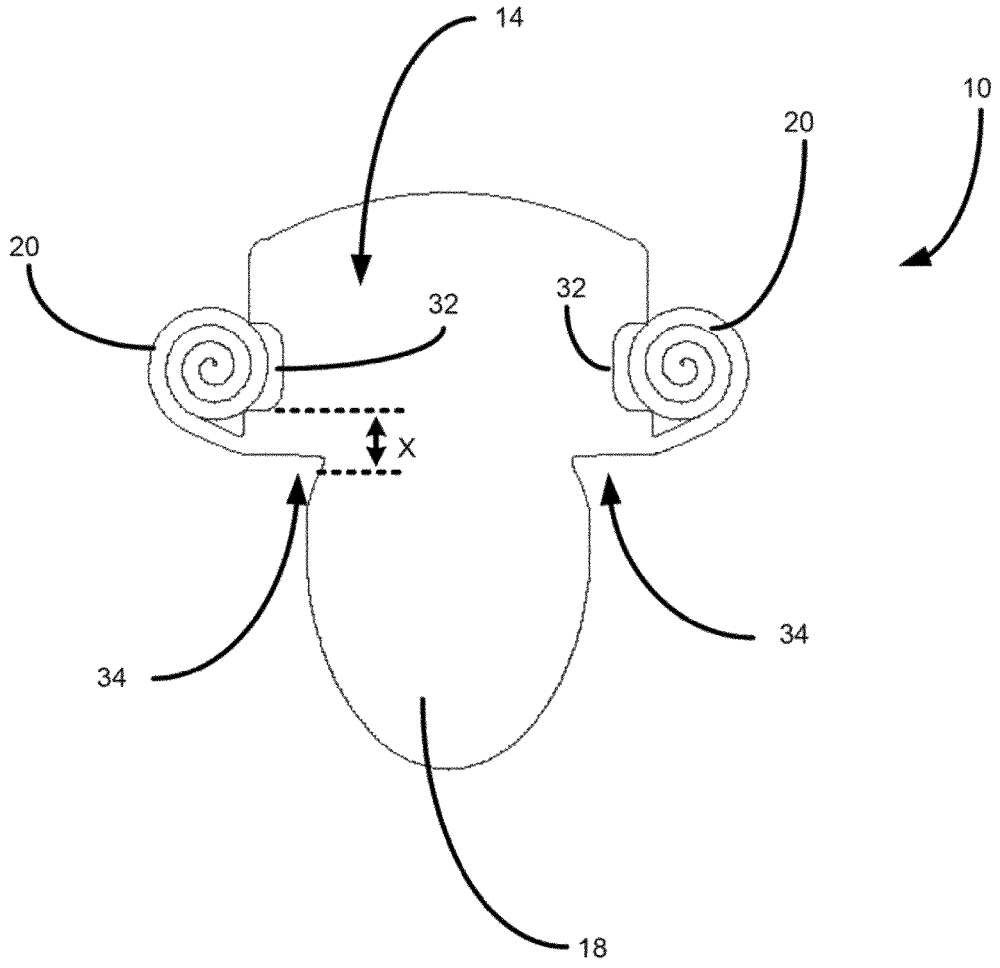
FIG. 4 is a side cross sectional view of the stopper in a retracted position.

FIG. 3 is a cross sectional view of the stopper 10 with the sheath 20 in the rolled down or extended position. FIG. 4 is a side cross sectional view of the stopper 10 in a retracted position. A ridge 28 may be optionally located circumferentially around an upper end 30 of the sheath 20. In addition, an annular groove 32 is located above the upper end 30 of the sheath 20. The groove and optionally the ridge circumferentially lie along the entire exterior surface above the upper end 30 of the sheath. The groove 32 is sized and shaped to retain the sheath in a rolled up or retracted position. In the preferred embodiment of the present invention, the stopper is configured to position the groove 32 and the ridge 28 above a lip of the container when the stopper is inserted into the opening of the container. Specifically, with the stopper configured to have the ridge located above the lip of the container, the sheath 20 hinges below ridge 28 at point A (see FIG. 3). Ridge 28 then remains in place below the groove and provides support to lock the rolled up sheath in place in both the situation where the lower surface region 34 is in contact with the upper lip of the container (e.g., when on the stopper is on the container) and the situation when the lower surface region 34 is not in contact with the container's lip (e.g., when the stopper is removed from the container to access the contents of the container or storage of the stopper). On the other hand, if the ridge 28 were to be located below the lip of the container, when the stopper is removed from the container, the sheath would hinge at point B (see FIG. 3) where the bottom the groove 32 would effectively collapse, thereby losing support for the rolled up sheath. Therefore, to enable the ridge 28 to remain in place, in the preferred embodiment of the present invention, both the ridge and groove are configured to be located above the lip of the container. Gaps 40 are formed between each side of the plug 18 and a portion of the interior walls 20. In the preferred embodiment of the present invention, the ridge 28 and the groove 32 are located above the top of the gaps 40. As discussed above, the ridge then sits against a solid material of the main body 12 and not against the gap, thereby preventing its collapse and providing support for holding the rolled up sheath in place, whether the stopper is located on the container or off the container.

As shown in FIG. 4, the sheath 20 is rolled up and positioned within the groove 32. The groove 32 is located within the upper portion 14 of the main body 12. The upper portion includes a lower surface region 34 which is sized and shaped to contact the upper lip 56 (see FIG. 6) of a bottle. The groove is located a distance X above the lower surface region. In the preferred embodiment of the present invention, the placement of the groove 32 and ridge 28 above the lower surface region 34 is important because this placement provides a stable area for retaining the sheath in the rolled up or retracted position, whether in place on the container or when the stopper is removed from the container. In particular, the ridge 28 locks the rolled up sheath in the groove.

Figure 5:
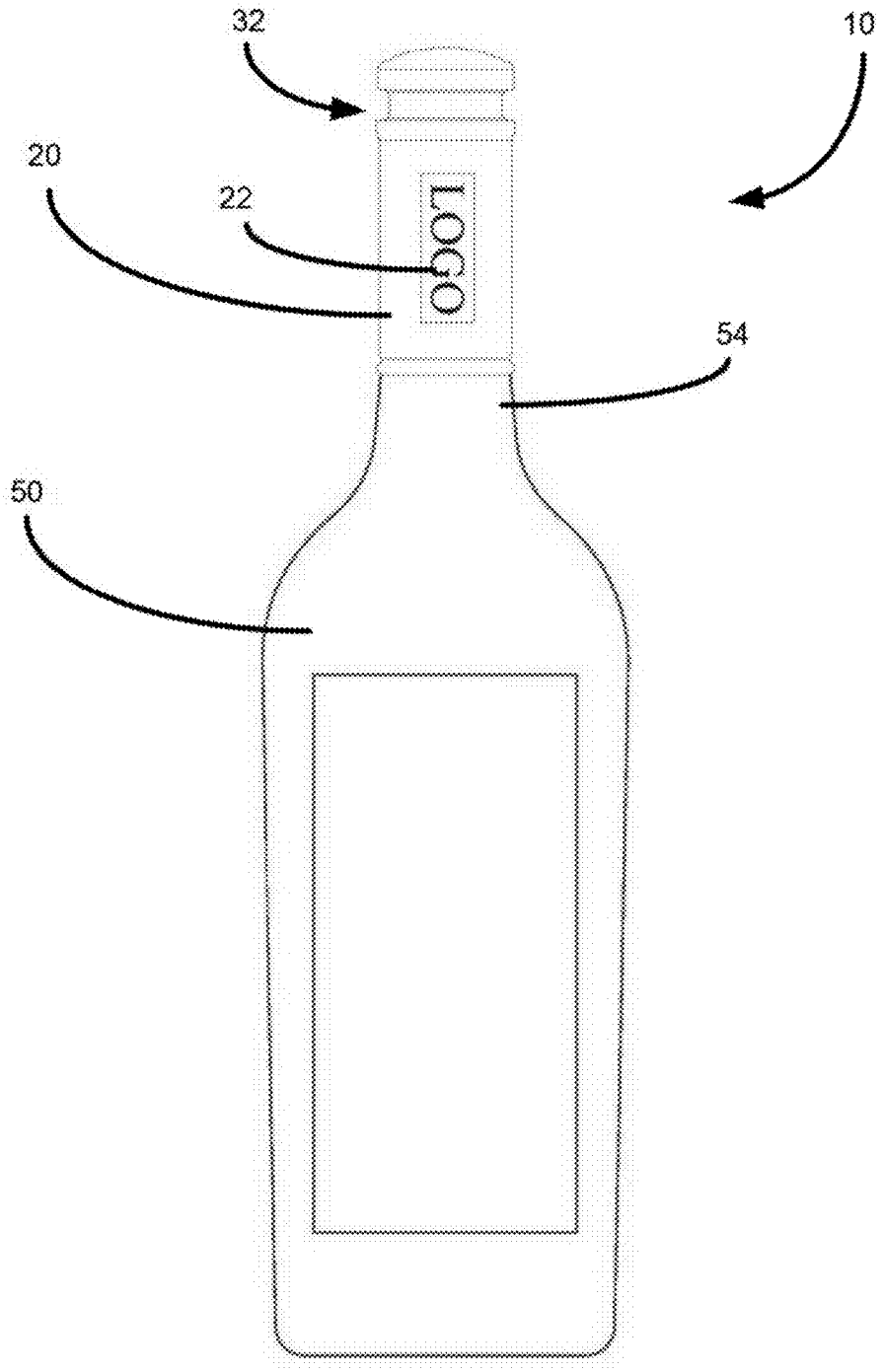
FIG. 5 is a side view of the stopper on a bottle with the sheath in the extended position.
Figure 6:
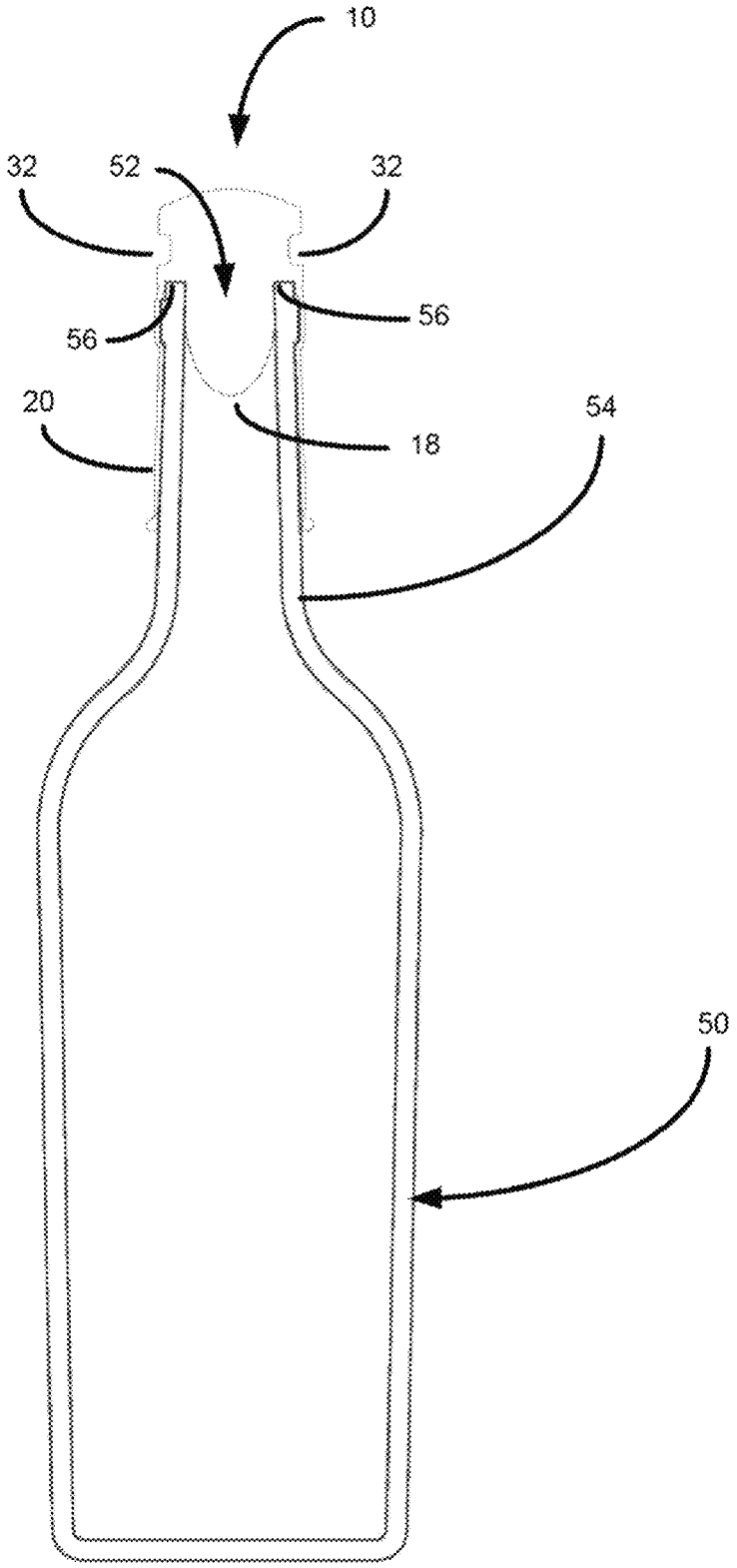
FIG. 6 is a cross sectional view of the stopper on the bottle.
Figure 7:
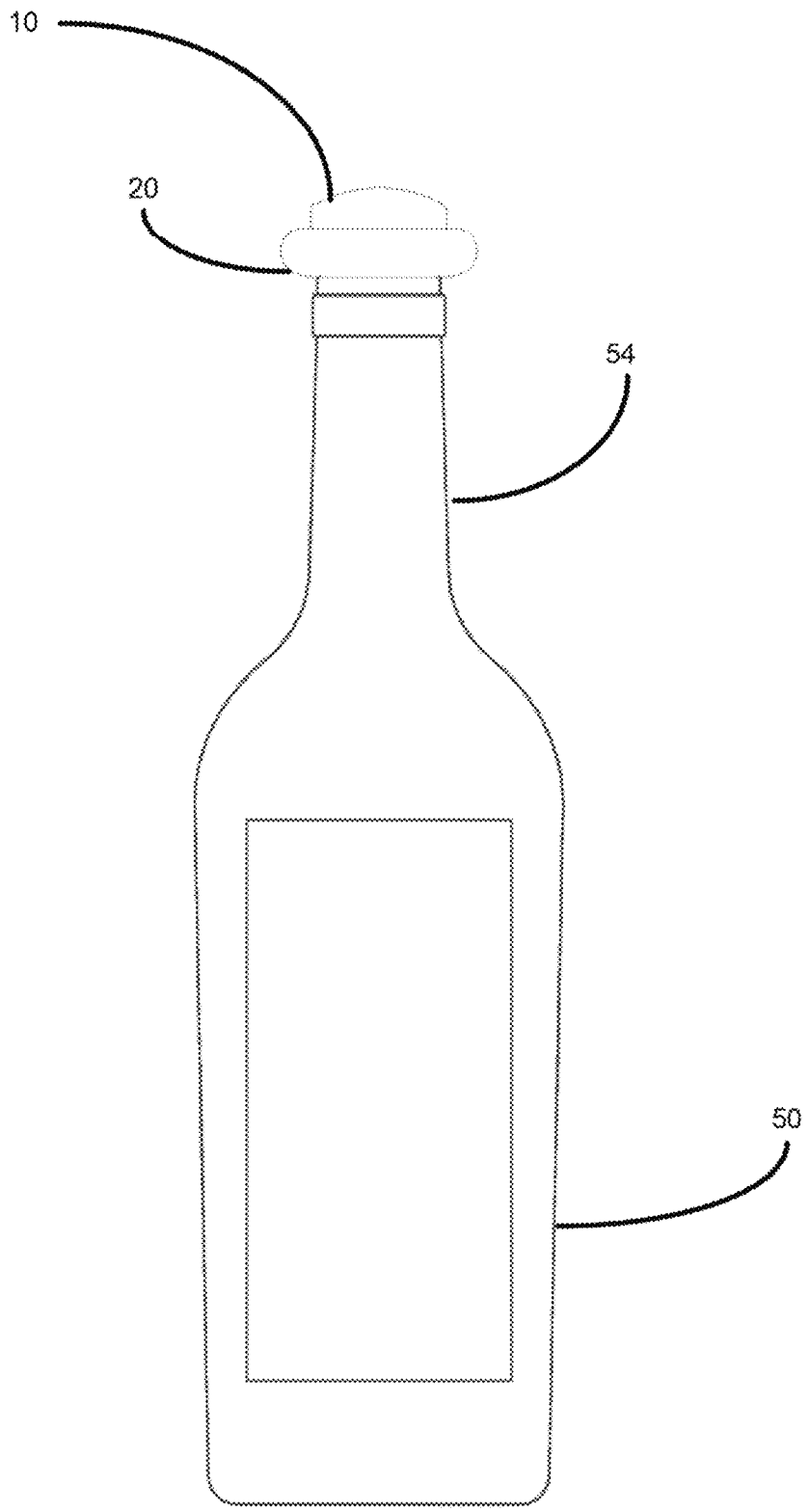
FIG. 7 is a side view of the stopper on the bottle with the sheath in the retracted position.
Figure 8:
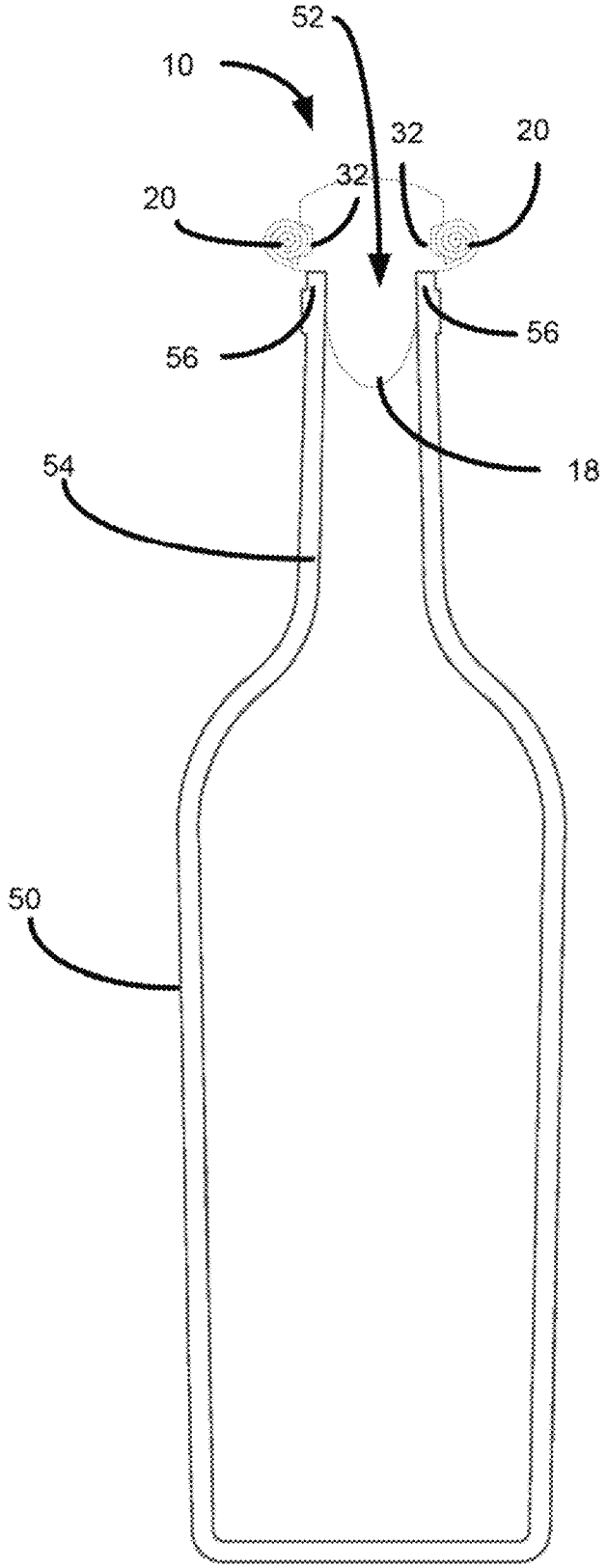
FIG. 8 is a cross section view of the stopper on the bottle with the sheath in the retracted position.
Figure 9:
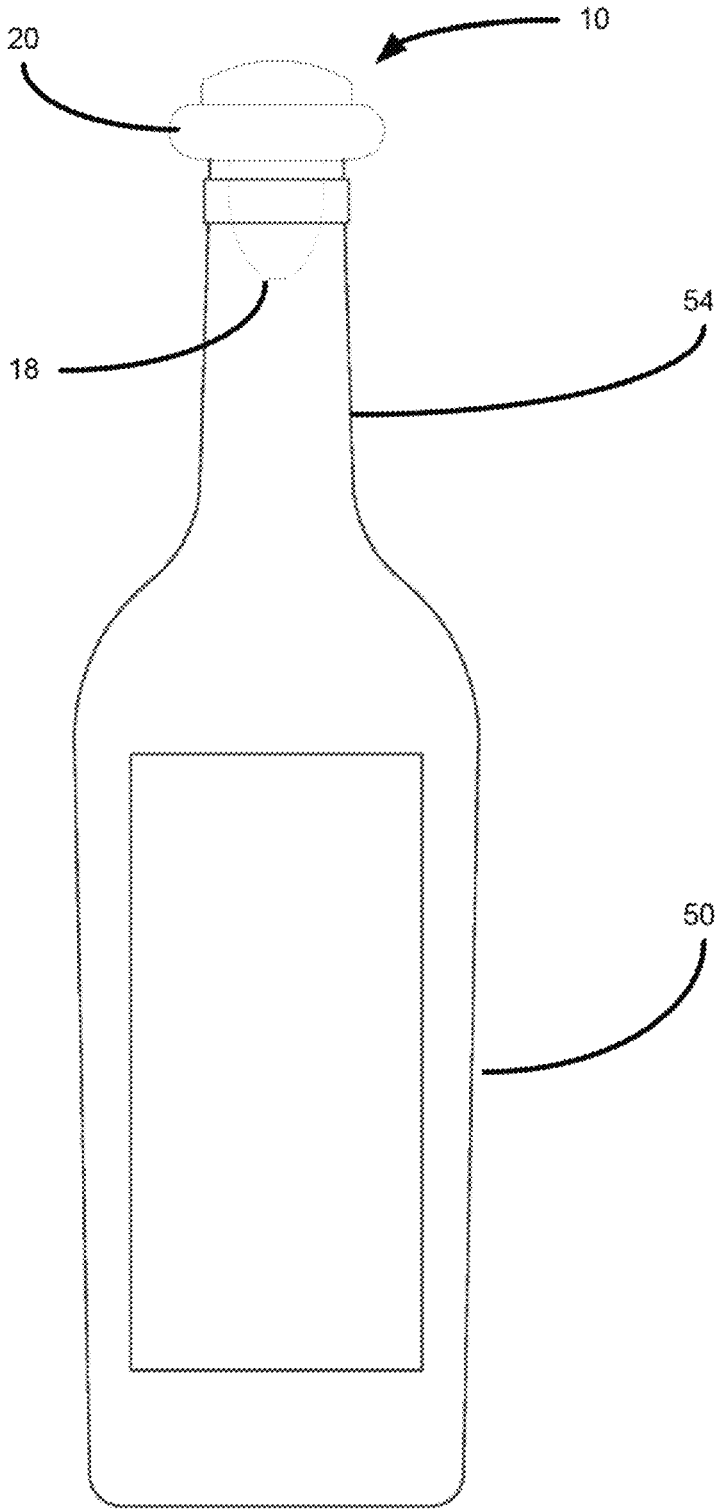
FIG. 9 is a side view illustrating the plug inserted into the bottle opening.

FIG. 5 is a side view of the stopper 10 on a bottle 50 with the sheath in the extended position. FIG. 6 is a cross sectional view of the stopper 10 on the bottle 50. The optional plug 18 fits within a bottle opening 52 located at an upper portion of a bottle stem 54. In FIGS. 5 and 6, the sheath 20 is shown in the extended or rolled down position. FIG. 7 is a side view of the stopper 10 on the bottle 50 with the sheath in the retracted position. FIG. 8 is a cross section view of the stopper 10 on the bottle 50 with the sheath in the retracted position. FIG. 9 is a side view illustrating the plug 18 inserted into the bottle opening 52.

With reference to FIGS. 1-9, the operation of the stopper 10 will now be explained. The stopper may be affixed to the container, such as the bottle 50, by placing the stopper atop the container stem 54, and if optional plug 18 is included in the stopper, inserting the plug 18 into the opening 52. The stopper is pushed until the upper portion of the stopper prevents further movement into the opening 52 of the bottle 50, specifically when the lower surface region 34 of the upper portion 14 of the stopper contacts the lip 56 of the bottle 50. Next, the sheath 20 is rolled downward to the extended or rolled down position (see FIGS. 5 and 6). In this position, an optional plug would provide a measure of sealing, as well as preventing any liquids, solids, or gases stored in the bottle from escaping. Solely or additionally, the stopper 10 may also provide sealing to prevent the entry of solids, liquids or gases into a container, vessel, or other similar device. The sheath adheres to the stem of the container or bottle preventing inadvertent dislodging of the stopper 10 and either sealing the opening if the optional plug 18 is absent or providing additional sealing surface area if the optional plug 18 is present. When access to the contents is desired by the user, the sheath 20 is rolled up to the retracted position and the stopper removed. Furthermore, the stopper may remain inserted within the bottle opening with the sheath in the rolled up or retracted position (see FIGS. 7-9). With the stopper still in place and the sheath retracted, the sheath may be retained in the retracted position by positioning the rolled up sheath in the groove 32. The configuration of the stopper allows the placement of the groove and ridge above the lip 56 of the bottle, allowing the stopper, by itself, to retain the rolled up sheath without any support from the mass or structure of the bottle. Thus, the size and shape of the stopper are such as to position the groove 32 and ridge 28 above the lip 56 of the bottle 50. Alternatively, the stopper is configured to position the groove 32 and ridge 28 above the top of the gap 40. The stopper 10 does not require any device to remove the stopper from the opening, whether the optional plug is included or not. With the stopper upon the bottle and the sheath in the retracted position, the mass and shape of the stopper allow the stopper to be gripped with the hand and removed (or levered if the optional plug is present) from the container. The stopper may then be reused as desired to store the liquids, solids, or gases within the bottle.

The stopper may be used for initial storage of liquids, solids, or gases in a container, such as the function performed by a traditional cork stopper. In addition, the stopper may be used after a cork or other stopper has been initially removed to allow the contents of the bottle to be stored and sealed after initial opening. Although one opening is illustrated and discussed, the present invention may be used for a container having more than one opening. Additionally, the container may be any device having an opening and an enclosure, such as the barrel of a firearm or a pipe. The present invention provides many advantages over existing devices. The present invention provides an ease in removing and applying the stopper 10 to a container. Furthermore, the present invention's sheath provides a unique and useful way of sealing or further sealing the contents within the container, no matter the container's angle of repose. Solely or additionally, the present invention may also provide sealing to prevent the entry of solids, liquids or gases into a container, vessel, or other similar device. Additionally, the stopper 10 may be conveniently stored apart from the container with the sheath in the retracted position, the sheath being secured against inadvertent dislodging from the groove which may occur during bumping or dropping.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A stopper for a container retaining liquids, solids, or gases, the stopper comprising:

a main body, wherein the main body includes an upper portion and a lower portion, the main body sized and shaped to fit over an opening of the container;

wherein the lower portion includes a plug sized and shaped to snugly fit the opening of the container; and a flexible sheath affixed to the stopper, the sheath being rollable down an exterior surface of the container a length below the lower portion of the main body to facilitate a seal of the container;

the main body having an annular groove sized and shaped to retain the sheath when rolled up wherein the main body includes a ridge adjacent and below the annular groove;

wherein the annular groove is located above a gap residing between the plug and interior walls of the sheath.

2. The stopper according to claim 1 wherein the annular groove and ridge are configured to be located above a lip of a container when the stopper is positioned on the container.

3. The stopper according to claim 1 wherein the sheath is circumferentially affixed to an outer surface of the main body.

4. The stopper according to claim 1 wherein the upper portion of the main body has a diameter greater than a diameter of an opening of the container.

5. The stopper according to claim 1 wherein the lower portion is sized and shaped to fit within the opening of the container to prevent liquids, solids, or gases contained in the container from exiting the opening.

6. The stopper according to claim 1 wherein the upper portion of the main body is sized and shaped to fit over the opening, the upper portion having a circumference greater than a circumference of a border of the opening.

7. The stopper according to claim 1 wherein the sheath is sized and shaped to have a circumference less than an outer circumference of the opening of the container.

8. The stopper according to claim 1 wherein the sheath is constructed of an elastic material.

9. The stopper according to claim 1 wherein the sheath is configured to fit tightly over an exterior surface of the container.

10. The stopper according to claim 1 wherein the seal prevents entry of liquids, solids or gases into an interior of the container.

11. The stopper according to claim 1 wherein the sheath is configured to roll down the exterior surface of the container below the main body a length necessary to develop the surface contact area, dictated by the coefficient of friction between the sheath and the exterior surface of the container, required to contain pressure of contents held within the container.

12. The stopper according to claim 1 wherein the annular groove is configured to be located above a lip of a container.

13. The stopper according to claim 1 wherein the annular groove is configured to be located above a lip of a container when the stopper is positioned on the container.

* * * * *